United States Patent [19]

Flynn

[11] Patent Number: 4,896,092

[45] Date of Patent: Jan. 23, 1990

[54] VOLTAGE REGULATOR FOR AC SINGLE PHASE AND THREE PHASE SYSTEMS

[75] Inventor: Gordon E. Flynn, Richmond, Va.

[73] Assignee: Power Distribution, Inc., Richmond, Va.

[21] Appl. No.: 256,459

[22] Filed: Oct. 12, 1988

[51] Int. Cl.[4] ..... G05F 1/16

[52] U.S. Cl. ..... 323/258; 323/340

[58] Field of Search ..... 323/237, 255, 256, 258, 323/259, 263, 320, 339, 340, 341, 344

[56] References Cited

U.S. PATENT DOCUMENTS

| | | | |
|---|---|---|---|
| 3,128,440 | 4/1964 | Davis . | |
| 3,295,053 | 12/1966 | Perrins . | |
| 3,444,457 | 5/1969 | Rosa | 323/258 |
| 3,530,369 | 9/1970 | Thompson | 323/258 |
| 3,600,664 | 8/1971 | Goldberg et al. . | |
| 3,600,668 | 8/1971 | Goldberg . | |
| 3,611,117 | 10/1971 | Schneider . | |
| 3,621,374 | 11/1971 | Kettler . | |
| 3,684,949 | 8/1972 | Yamachi et al. . | |
| 3,706,024 | 12/1972 | Wood | 323/258 |
| 3,732,485 | 5/1973 | Kettler . | |
| 3,732,486 | 5/1973 | Schoendube . | |
| 4,429,269 | 1/1984 | Brown | 323/301 |

*Primary Examiner*—Patrick R. Salce
*Assistant Examiner*—Emanuel Todd Voeltz
*Attorney, Agent, or Firm*—Richard P. Matthews

[57] ABSTRACT

A voltage regulator for AC single phase and three phase systems. An output voltage is controlled by controlling a preset stepped addition to or subtraction from the input voltage. The controlled addition or subtraction is performed by a series injection transformer whose secondary is in series with the input voltage and whose primary is controlled by a microprocessor based switch matrix. The switch matrix imposes various voltage levels and phasing on the primary winding so as to produce a regulated system output voltage.

3 Claims, 5 Drawing Sheets

VOLTAGE REGULATOR FOR AC SINGLE PHASE AND THREE PHASE SYSTEMS

This invention relates to a voltage regulator for AC single phase and three phase systems and, more particularly, to a voltage regulator for such systems wherein the voltage correction is made by a microprocessor based switch matrix.

BACKGROUND OF THE INVENTION

Heretofore it has been known to provide voltage regulation wherein the input voltage was sensed by a potential transformer and the output current was sensed by a current transformer. The known technology also requires the concurrent adjustment of three potentimeters and a means of actually adjusting the input voltage level. This has resulted not only in an expensive apparatus but also one that is cumbersome and not possessive of the novel features of the present invention.

SUMMARY OF THE INVENTION

In accordance with the present invention it becomes possible to sense the output voltage at the locus of its use. This provides a more stable feedback control and allows for remote sensing at the actual load. Thus, it becomes possible to compensate for power line voltage drop, over a distance, caused by the actual load. Secondly, it becomes possible to eliminate potential transfer and current feedback transformers from the voltage regulating system. This reduction in components provides decreased cost and increased reliability. Thirdly, there is a reduction in solid state devices within the switch matrix. This provides a decrease in cost and greater reliability because fewer components are employed. Finally, a simplified calibration method may be utilized. In particular, a single potentiometer on a circuit board is used while the output is monitored with a standard voltmeter. Previous technology requires the concurrent adjustment of three potentiometers and a means of actually adjusting the input voltage level.

The inherent advantages and improvements of the present invention will become more readily apparent upon reference to the following detailed description of the invention and by reference to the drawings wherein.

DETAILED DESCRIPTION OF THE INVENTION

Figure 1:
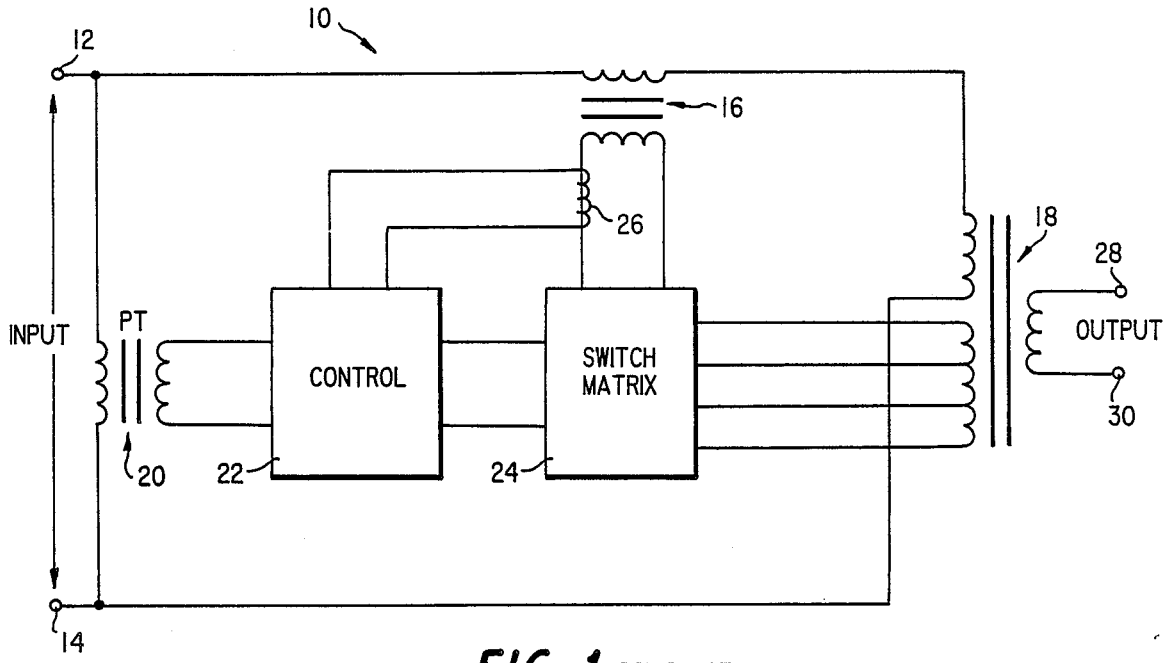
FIG. 1 PRIOR ART
FIG. 1 is a schematic diagram of a prior art voltage regulator.

Referring now to FIG. 1 of the drawings, there is illustrated a block diagram of existing prior art technology wherein a voltage regulator circuit is designated generally at 10. An input voltage is applied across input terminals 12, 14. The secondary of a transformer 16 is shown in series with the input and an output current transformer is shown at 18. A potential transformer 20 is connected across input terminals 12, 14 and it provides the drive for control circuit 22. Switch matrix 24 containing ten triacs receives an input from the output current transformer 18 and control circuit 22. The control circuit also provides an output to a current transformer which is mixed with the output of the switch matrix to provide a regulated voltage which is received at output terminals 28, 30.

Figure 2:
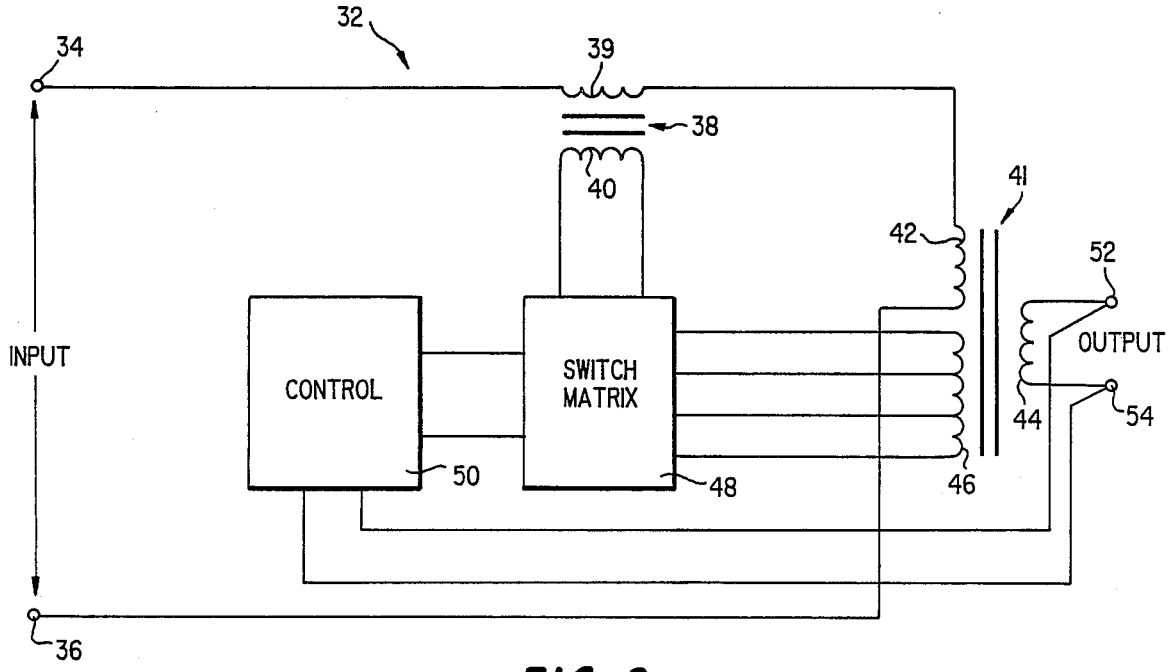
FIG. 2 is a schematic diagram of a voltage regulator in accordance with the present invention.

An improved design for a voltage regulator circuit of the present invention, designated generally at 32, is shown in FIG. 2. Reference to this figure indicates an input voltage which is received from an AC source across input terminals 34, 36. A series injection transformer indicated generally at 38 has its secondary winding 39 in series with input terminal 34 and its primary winding at 40. Under normal conditions without voltage regulator correction this AC input voltage is also present at primary winding 42 of an output transformer designated generally at 41. Output transformer 41 has two additional windings, namely, an AC output winding 44 and a multi-tap winding 46. The multi-tap winding 46 provides the source voltage for a switch matrix 48 which is shown in detail in FIG. 5. Output winding 44 has output terminals 52, 54 which are connected to control circuit 50 which is shown in detail in FIG. 4.

Figure 3:
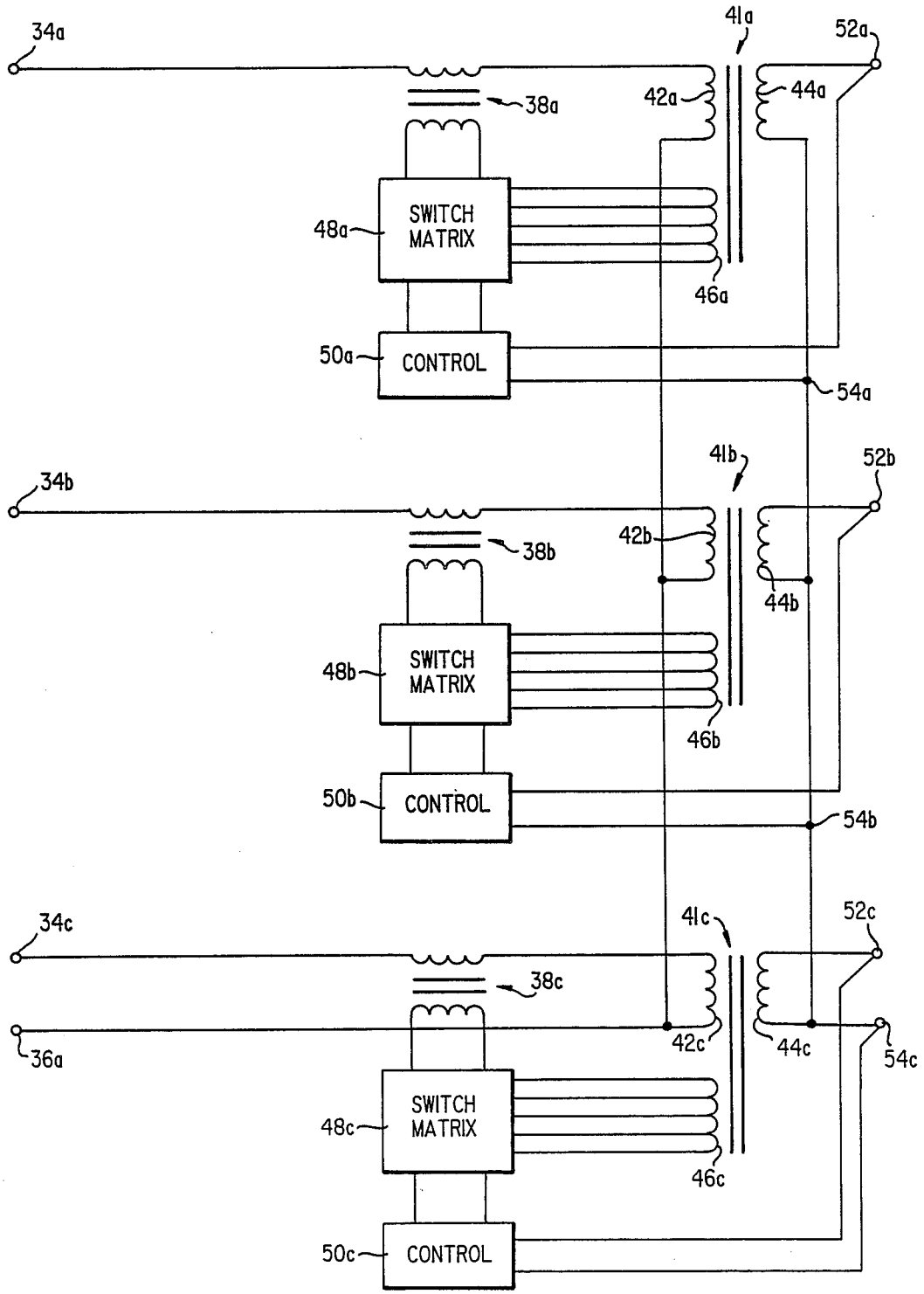
FIG. 3 is a schematic diagram of voltage regulator in accordance with another embodiment of the present invention.

Reference to FIG. 3 shows a three phase circuit which comprises three identical single phase circuits. The numerals shown in FIG. 3 have suffixes a, b and c added thereto to illustrate comparable items from the single phase system of FIG. 2.

Figure 4:
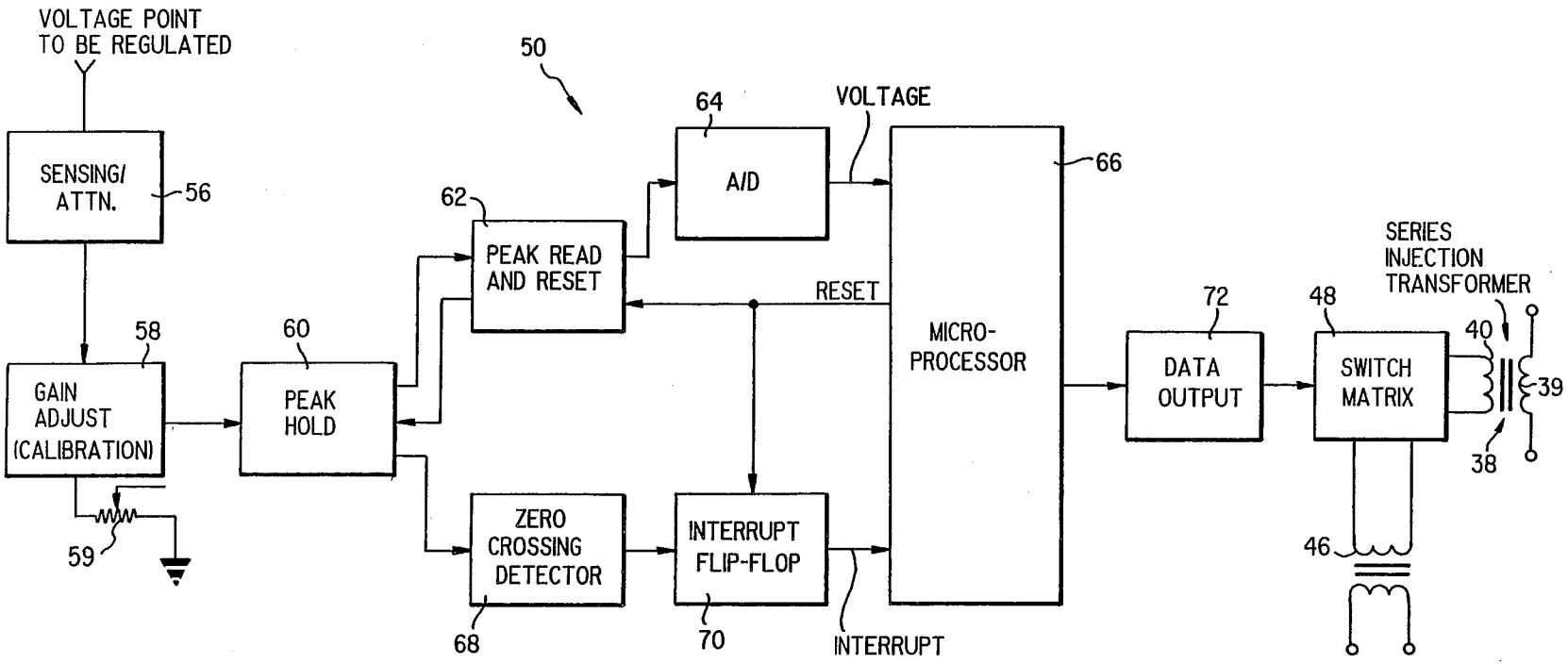
FIG. 4 is a block diagram of a control flow diagram of the present invention.

Reference is now made to FIG. 4 which illustrates the detailed control circuit indicated generally at 50. The output from output terminals 52, 54 which constitutes the voltage point to be regulated is applied to a sensing/attenuation means 56. The control circuit attenuates the voltage level and then applies the attenuated voltage to an adjustable gain amplifier 58 which includes a single potentiometer 59 to provide single point or single control calibration. The absolute value of this voltage is then applied to a conventional peak and hold circuit 60 which stores the peak voltage every half cycle. Numeral 62 designates a peak read and reset block which reads the peak voltage, applies it to an analog to digital converter 64 for supplying an input to microprocessor 66.

Figure 6:
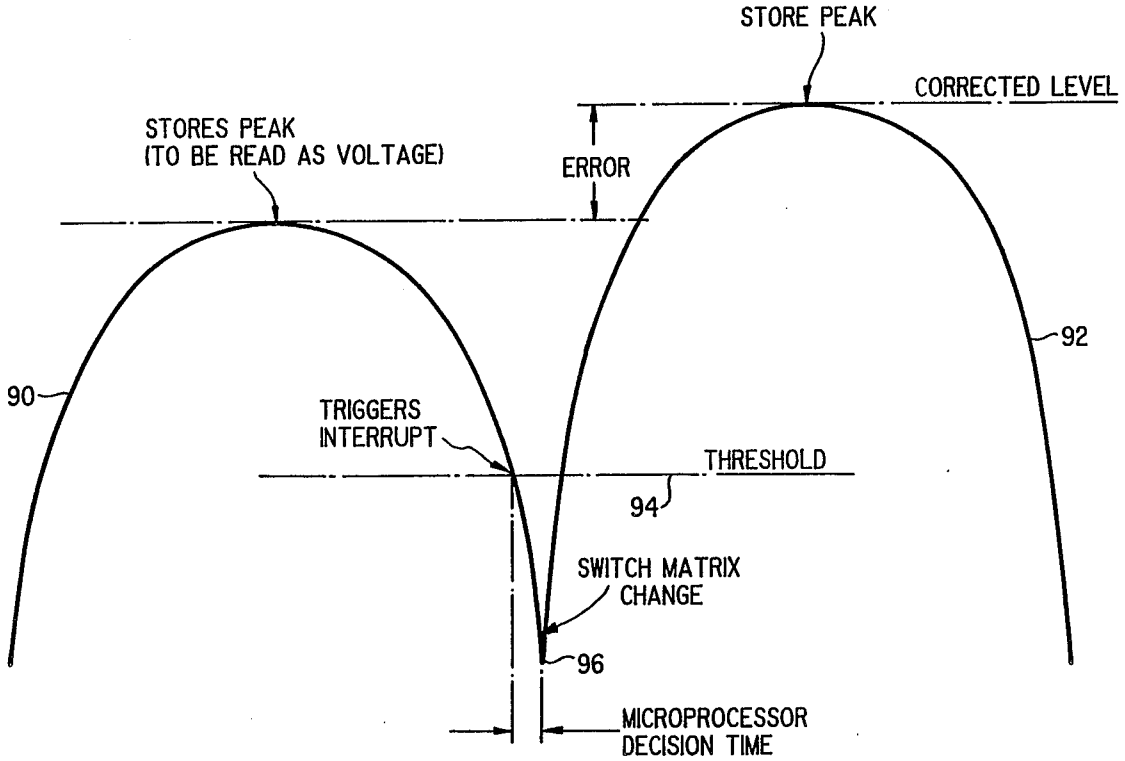
FIG. 6 is a schematic representation of the waveform response versus the control waveform for the present invention.

A zero crossing detection circuit 68 is triggered once the voltage level drops below a set threshold. This is graphically illustrated in FIG. 6 wherein numeral 90 designates the stored peak voltage and numeral 92 designates the corrected peak voltage level. When waveform 90 drops below threshold voltage level 94, this sets interrupt flip-flop circuit 70 (FIG. 4) to trigger a microprocessor interrupt. A finite decision time is thus provided the microprocessor 66 from the time waveform 90 crosses threshold 94 until the waveform reverses direction at 96 to read the peak voltage level, make a decision as to the need for a corrective voltage, provide output data 72 to drive switch matrix 48 and provide a reset for the peak and hold circuit 60.

Figure 5:
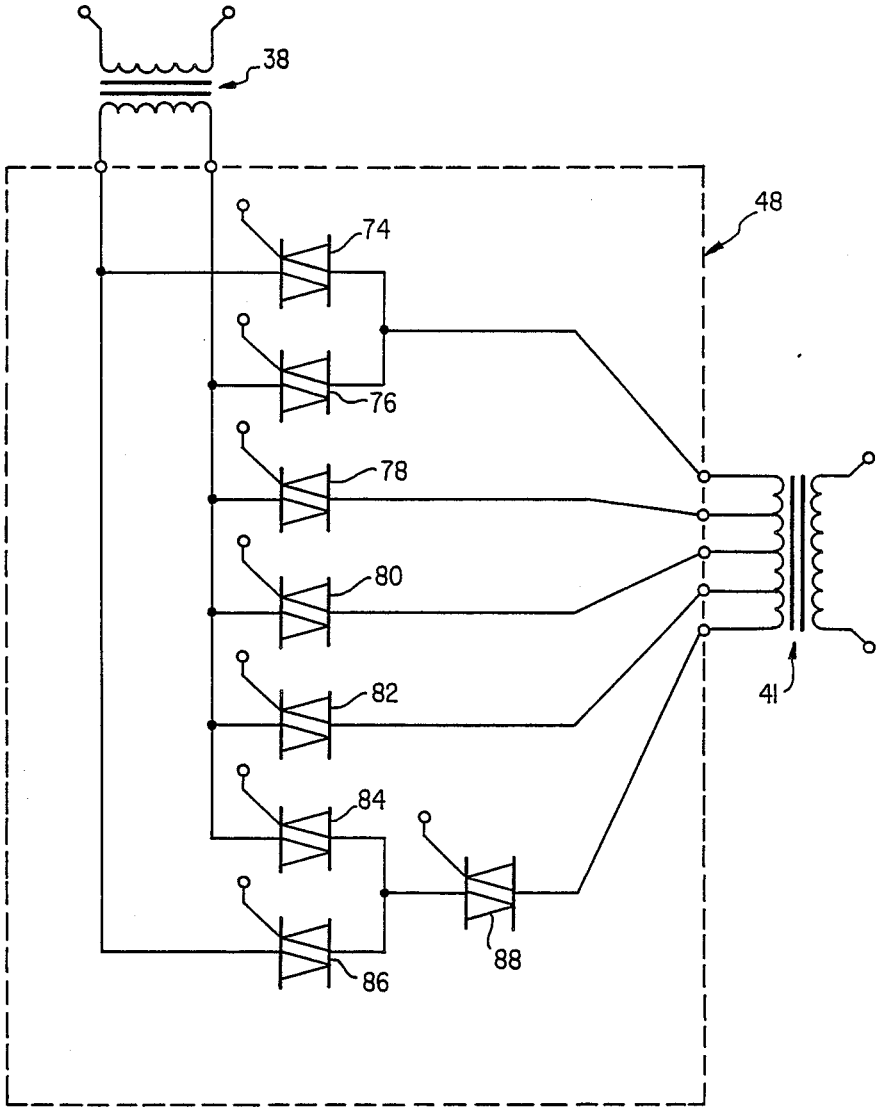
FIG. 5 is a schematic diagram of a switch matrix for the present invention.

The switch matrix 48 which comprises eight triacs 74, 76, 78, 80, 82, 84, 86 and 88 as arranged in FIG. 5 then applies the proper voltage level and phase to the primary winding 40 of the series injection transformer 38. This transformer, through its turn ratio and secondary windings, either adds to or subtracts from the input voltage level to maintain the desired output voltage.

Since the device is a voltage regulator, at nominal input voltage no corrective action is taken. If the output voltage were either to increase or decrease, because of variations in input voltage or load conditions, the control circuit would respond to maintain the output voltage level.

While presently preferred embodiments of the invention have been illustrated and described, it will be recognized that the invention may be otherwise variously embodied and practiced within the scope of the claims which follow.

I claim;

1. A voltage regulator for alternating current single phase and three phase systems which comprises a. an input terminal, b. a series injection transformer having primary and secondary windings with said secondary winding being in series with said input terminal, c. an output transformer with tertiary windings which include i. a primary winding in series with said secondary winding of said series injection transformer, ii. a system output AC voltage winding, iii. and a multi-tap winding, d. a switch matrix which receives its source voltage from said multi-tap winding, e. and control means including a microprocessor for receiving the output voltage from said system output AC voltage winding and for driving said switch matrix, i. said control means includes a peak and hold circuit which stores the peak voltage every half cycle, f. said switch matrix applying the proper voltage level and phase to the primary of said series injection transformer to effect voltage regulation.

2. A voltage regulator as defined in claim 1 wherein said control means further includes a zero crossing circuit which is triggered once the voltage level drops below a set threshold with said triggering causing a flip-flop circuit to provide a microprocessor interrupt during which time said microprocessor reads the peak voltage level, makes a decision with respect thereto, provides output data to drive said switch matrix and provides a reset for said peak and hold circuit.

3. A voltage regulator as defined in claim 1 wherein a single potentiometer in said control means is used to adjust the output voltage level.

* * * * *